United States Patent [19]

Sacca

[11] Patent Number: 4,535,839

[45] Date of Patent: Aug. 20, 1985

[54] HEAT EXCHANGER WITH CONVOLUTED AIR CENTER STRIP

[75] Inventor: Demetrio B. Sacca, Lockport, N.Y.

[73] Assignee: General Motors Corporation, Detroit, Mich.

[21] Appl. No.: 450,963

[22] Filed: Dec. 20, 1982

[51] Int. Cl.[3] ..... F28F 1/22; F28F 3/06

[52] U.S. Cl. ..... 165/153; 165/167

[58] Field of Search ..... 165/152, 153, 166, 167

[56] References Cited

U.S. PATENT DOCUMENTS

| | | | |
|---|---|---|---|
| 937,380 | 10/1909 | Miller | 165/153 |
| 2,858,112 | 10/1958 | Gerstung | 165/153 |
| 3,250,325 | 5/1966 | Rhodes et al. | 165/153 |
| 4,002,201 | 1/1977 | Donaldson | 165/153 |
| 4,023,618 | 5/1977 | Kun et al. | 165/152 X |
| 4,249,597 | 2/1981 | Carey | 165/153 |
| 4,328,861 | 5/1982 | Cheong et al. | 165/153 X |
| 4,332,293 | 6/1982 | Hiramatsu | 165/153 |
| 4,470,455 | 9/1984 | Sacca | 165/153 X |

FOREIGN PATENT DOCUMENTS

| | | | |
|---|---|---|---|
| 57644 | 4/1923 | Sweden | 165/152 |
| 662281 | 12/1951 | United Kingdom | 165/153 |

*Primary Examiner*—Sheldon J. Richter

*Attorney, Agent, or Firm*—R. L. Phillips

[57] ABSTRACT

A heat exchanger is disclosed having an air center strip with imperforate ends.

2 Claims, 4 Drawing Figures

HEAT EXCHANGER WITH CONVOLUTED AIR CENTER STRIP

This invention relates to heat exchangers of the plate type having air centers formed of convoluted strips and more particularly to the louvering of such strips for increased heat transfer.

In heat exchangers such as refrigerant evaporators of the plate type, louvered air centers are provided which are commonly made from strip stock in a very cost-effective way. In such manufacture, rows of louvers are first formed across the width of the strip as it is advanced from a roll and the advancing louvered strip is bent into the desired convoluted shape and finally cut to length so as to fit in a space provided between the plates forming adjacent tube passes. The air center strips are joined at their crests to the tube plates and the spaces between the convolutions define air passages along the sides of the fins formed by the convolution lengths. The louvers interconnect the adjacent air passages along their length and thereby provide for increased heat transfer relationship with the fins or convolution lengths. In such an arrangement, the tube passes are typically fluid interconnected or at least physically joined at their opposite ends by manifolds formed integral with the plates. These manifolds are provided by the ends of the plates being formed with a drawn cup configuration which joins with a like configuration formed on the plate of the adjacent tube pass. It is desirable from a core strength (burst pressure) standpoint that such drawn cup be circular in cross section. However, there is an attended problem in that with such a round cup the air can leak out of the adjacent air center passage (end passage) through its louvers on the entrance or front side of the core and bypass around the round cup and then leak through the louvers and back into this end air center passage on the exit or backside of the core. This bypass air is thus not in contact with much of the heat exchange surface and consequently may not be sufficiently cooled. For example, cooling losses of as much as five percent have been measured with such a round cup configuration. One proposal for solving this problem was to form the tube plates with baffles that prevent such bypass around the round cup; however, these baffles have not proved entirely satisfactory. As a result, the drawn cups have been provided with a "D"-shape cross-section which because of its straight side at the end air center passage limits bypass air but also substantially lowers the core's burst strength. The net result is that for an equivalent core strength, tube plates with a D-shaped cup must be thicker as compared with a round cup because of the lack of a cost-effective sealing arrangement for the latter which would prevent bypass air.

The present invention allows the use of a round cup for increased core strength with a low-cost seal that effectively eliminates any bypass air around such cup. This is accomplished with a very simple inexpensive modification just of the conventional louvered convoluted strip forming the air center. As described earlier, a very cost-effective way to manufacture the air centers results in the louvers being in each convolution length and thus in each end convolution of the air center strip. It has been discovered that by simply taking the last convolution at both ends of the air center strips and making them imperforate, it is possible to prevent any such air leakage from the end air center passages. As will be shown in the preferred embodiment with the conventional method of manufacture of the air center strips, all that is required is to simply shut or close the previously formed louvers in the last convolution at both ends of the air center strips after they have been cut to length. However, it will also be appreciated that with suitable tooling, and knowing the exact length of the air center strip desired, the louvers may be simply eliminated from the eventually formed convolution at each end of the strip. With the present invention and utilizing the round cup, the tube plate thickness can thus be made thinner without sacrificing either burst pressure strength or cooling effect. Moreover, it will be seen that the present invention can be adapted to other types of heat exchangers having louvered convoluted air center strips with similar air leakage problems.

These and other objects, advantages and features of the present invention will become more apparent from the following description and drawing in which.

Figure 1:
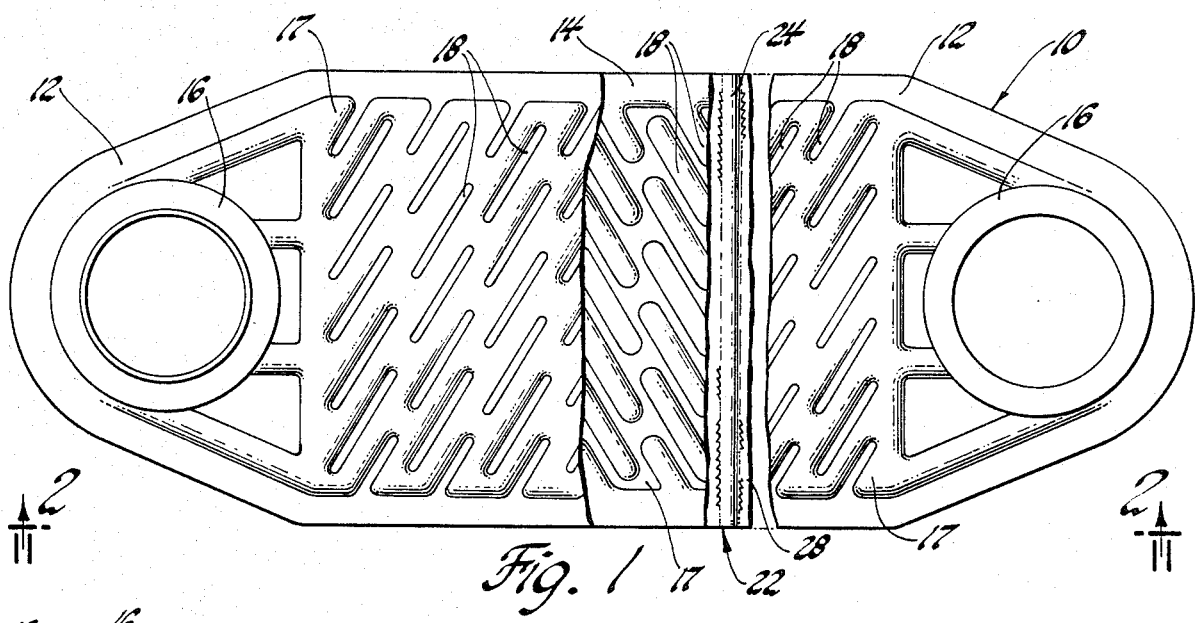
FIG. 1 is a planar view of a heat exchanger of the plate type having air center strips constructed according to the preferred embodiment of the present invention; the heat exchanger being shown progressively broken away from left to right to expose the various parts.
Figure 2:
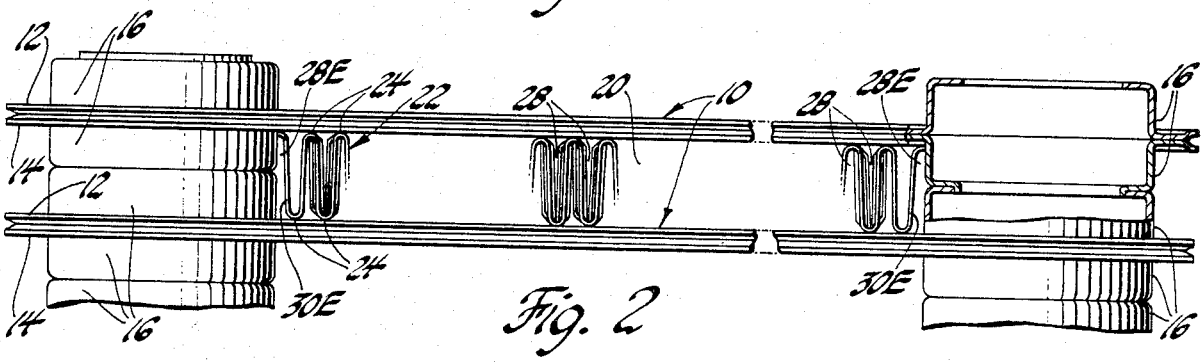
FIG. 2 is an elevational view of two stacked tube passes and part of a third forming a portion of the heat exchanger and looking in the direction of the arrows 2—2 in FIG. 1.

Referring to the drawing, there is shown a heat exchanger of the plate type adapted for use as a refrigerant evaporator. As seen in FIGS. 1 and 2, the evaporator comprises a plurality of tube passes 10 (only two and part of a third being shown) each of which consists of plate members 12 and 14. The plate members 12 and 14 are formed with identical configurations including a drawn cup 16 at each end of round cross-section and an interconnecting channel configuration 17 including staggered and overlapping ribs 18. The configurations are such that one plate can be inverted and rotated 180° relative to another with such paired plates then stackable to form any number of tube passes with interconnected ends. The plates 12 and 14 are further configured such that a space 20 is formed between adjacent tube passes to receive a convoluted or corrugated air center strip 22. The crests 24 of each convoluted air center strip contact the plates forming the adjacent tube passes and the strip in addition has rows of louvers 26 with the louvers in each row spaced across the strip width (see FIG. 4) and extending lengthwise along each convolution length (see FIG. 3) so as to provide increased heat transfer relationship of the air with the fins thus formed by the convolution lengths. The tube pass plates and the lengthwise located air center strips are brazed or soldered together to form the heat exchanger core which as adapted to be used as an evaporator in an air conditioning or refrigeration system has gaseous refrigerant entering the manifold formed by the adjoining cups 16 at one end of the core and then passing through the parallel tube passes and exiting the manifold similarly formed at the other end of the core. The plate type heat exchanger thus far described is like that disclosed in my U.S. Pat. No. 4,470,455 filed Jan. 11, 1982 which is assigned to the assignee of the present invention and is hereby incorporated by reference.

Figure 4:
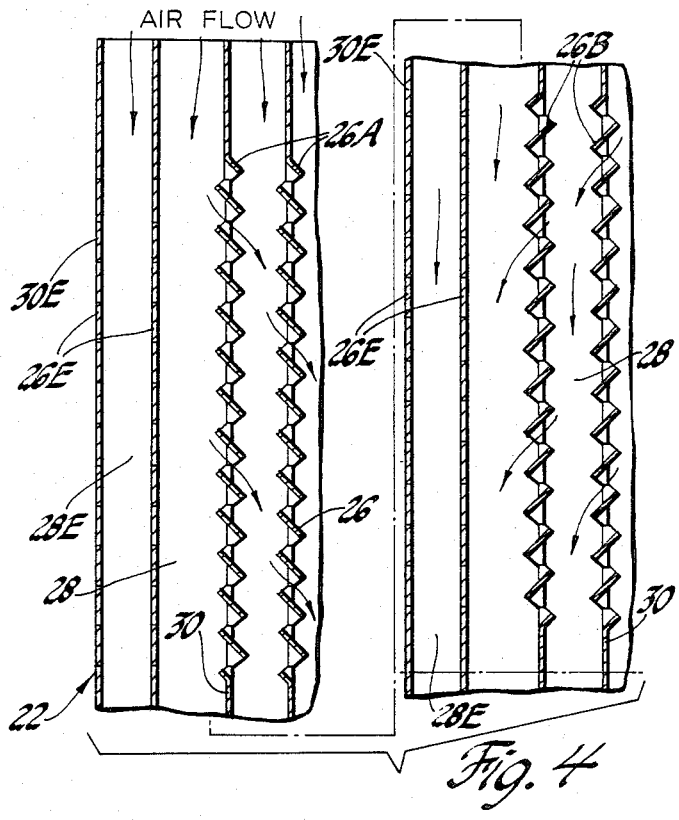
FIG. 4 is a cross-sectional view looking in the direction of the arrows 4—4 in FIG. 3.

The preferred embodiment of the present invention as will now be described allows the continued use of the conventional method of manufacturing the air center strips. In such manufacture, the air centers are formed from a strip of roll stock of the desired width. First, the rows of louvers are formed thereacross by piercing and forming and thereafter the thus louvered strip is formed into the desired convoluted shape and finally cut to length as determined by the distance between the drawn cups. As shown in FIG. 4, half of the louvers 26A in each row are formed at one angle transverse to the normal air flow direction shown by the arrows and the remaining half of the louvers 26B in each row are formed at the opposite angle. The adjacent air passages 28 formed by the spaces between the convolutions 30 are thus interconnected along their length and some of the passing air is forced by the oppositely angled louvers 26A and 26B to flow between the adjacent passages as it progresses from the entrance or front side of the core to the exit or rear side of the core across the width of the tube passes. But as a result, the air passage 28E at both ends of each air center strip would normally be open with air permitted to leak through the louvers 26A on the front side around the round drawn cup and then leak through the louvers 26B on the back side of the core. This bypass of air would thus not be in contact with much of the heat exchanger surface and consequently may not be sufficiently cooled, i.e. a loss in cooling effect. For example, a loss of as much as five percent in cooling effect has been measured as earlier indicated.

Figure 3:
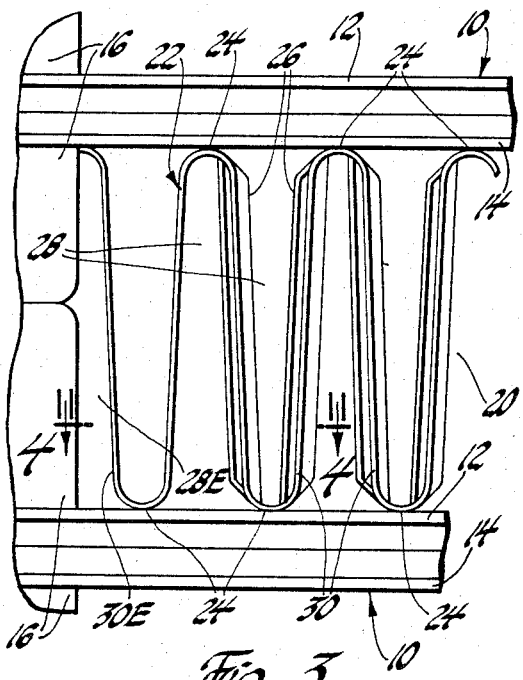
FIG. 3 is an enlarged elevational view of one end portion of the air center strip in FIG. 2.

According to the present invention, such leakage from the ends of the air centers is positively eliminated by simply closing the already formed louvers 26E in the end convolution 30E at both ends of the air center strip as shown in FIGS. 2, 3 and 4. This can be accomplished by any suitable metal forming method such as rolling, wiping, pressing, etc. In the preferred embodiment shown, the two rows of louvers in the last complete convolution of each strip are closed, i.e. the last two rows at each end of the air center strip. However, it will be understood that primarily the last row of louvers is closed to effect the seal and that the closing of the second row of louvers from the end is a secondary or backup measure against end leakage. Moreover, it will be appreciated by those skilled in the art that the above solution to air leakage from the ends of an air center strip is also adaptable to other type heat exchangers having a similar problem.

The above described preferred embodiment is illustrative of the invention which may be modified within the scope of the appended claims.

The embodiments of the invention in which an exclusive property or privilege is claimed are defined as follows:

1. In a heat exchanger having adjacent tube passes formed by plates with adjoining cup configurations at their ends wherein a convoluted air center strip with rows of louvers across the width thereof is located between the plates of adjacent tube passes with its ends adjacent the cup configurations: an improved air center strip having at least one row of louvers at both ends of the strip closed so as to prevent air leakage through the ends of the strip around the adjoining cup configurations.

2. In a heat exchanger having adjacent tube passes formed by plates with adjoining round-shaped configurations at their ends wherein a convoluted air center strip with rows of louvers across the width thereof is located lengthwise between the plates of adjacent tube passes with its ends adjacent the round-shaped configurations: an improved air center strip having the louvers in the last convolution at both ends of the strip closed so as to prevent air leakage through the ends of the strip around the round-shaped configurations.

* * * * *